United States Patent [19]

Bardsley et al.

[11] 4,185,568

[45] Jan. 29, 1980

[54] CUTTING INSTRUMENTALITIES FOR TUFTING MACHINES

[75] Inventors: Harold B. Bardsley, Euxton, Nr. Chorley; Harry Priestley, St. Annes on Sea, both of England

[73] Assignee: Spencer Wright Industries, Inc., Chattanooga, Tenn.

[21] Appl. No.: 934,001

[22] Filed: Aug. 16, 1978

[30] Foreign Application Priority Data

Mar. 1, 1978 [GB] United Kingdom ..... 8096/78
Aug. 31, 1978 [GB] United Kingdom ..... 36281/78

[51] Int. Cl.[2] ..... D05C 15/00
[52] U.S. Cl. ..... 112/79 R
[58] Field of Search ..... 112/79A, 79 R

[56] References Cited

U.S. PATENT DOCUMENTS

| | | | |
|---|---|---|---|
| 3,277,852 | 10/1966 | Card | 112/79 R |
| 3,604,379 | 9/1971 | Cobble | 112/79 R |
| 3,735,715 | 5/1973 | Passon et al. | 112/79 R |
| 3,757,709 | 9/1973 | Cobble | 112/79 R |
| 3,788,245 | 1/1974 | Bonner | 112/79 R |
| 4,009,669 | 3/1977 | Wear | 112/79 R |
| 4,061,095 | 12/1977 | Price | 112/79 R |
| 4,067,270 | 1/1978 | Short | 112/79 R |
| 4,069,776 | 1/1978 | Cobble | 112/79 R |

FOREIGN PATENT DOCUMENTS

| | | | |
|---|---|---|---|
| 1309961 | 3/1973 | United Kingdom | 112/79 R |

*Primary Examiner*—Ronald Feldbaum
*Attorney, Agent, or Firm*—Alan Ruderman

[57] ABSTRACT

A cutting instrumentality for tufting machines having a multiplicity of knife bar modules arranged in end-to-end disposition to form a knife bar of a length coextensive with the intended operating width of the tufting machine. Each module has a multiplicity of spaced apart parallel holes each for receiving a knife block mounting spigot. Each knife block supports a plurality of knives in parallel side-by-side disposition on each side of a central web. The knives are secured within the block by capping pieces slidable on pins within an aperature in the block and engageable with an edge of selected knives. Each capping piece acts on a pair of knives, one on each side of the web. A member threaded into the block operates on each capping piece to secure the knives in position.

11 Claims, 10 Drawing Figures

CUTTING INSTRUMENTALITIES FOR TUFTING MACHINES

BACKGROUND OF THE INVENTION

The invention concerns tufting machines, and has more particular reference to cutting instrumentalities therefor.

In a tufting machine a multiplicity of yarn carrying needles arranged in side-by-side disposition upon a needle bar are caused to reciprocate relative to a backing fabric so as to pierce the same to draw yarn therethrough. At the reverse of the backing fabric each needle co-operates with a respective looper, the loopers being mounted on a common looper bar and oscillating about an axis parallel to the needle bar into or out of co-operative engagement with the respective needles to receive a loop of yarn therefrom and to retain the same on withdrawal of the needles from the backing fabric.

On a tufting machine for producing cut-pile fabrics, that is to say fabrics wherein the loops appear as pairs of single yarn elements extending from the surface of the backing fabric rather than as closed loops extending from such backing fabric, the tufting mechanism further includes a multiplicity of knives, one for each looper, whereby the loops held on the loopers are severed as they approach the back of the looper, the knives being mounted for oscillation relative to the loopers in timed relationship therewith in knife blocks adjustably mounted in a common knife bar.

In the tufting art the gauge of a pile fabric is determined by the spacing between adjacent gauge parts, i.e. the needles, loopers and knives, of the tufting machine, thus the spacing or pitch of the gauge parts is the measure of the pile fabric produced. In fine gauge fabrics, i.e. one tenth gauge or smaller, the pitch at which the gauge parts are set is 0.1 inch or smaller. As a consequence of the close spacing between adjacent gauge parts in fine gauge tufting machines difficulty has been experienced in providing arrangements wherein the spacing of the various gauge parts might be set at a requisite level and maintained at such level.

SUMMARY OF THE INVENTION

The primary object of the present invention is to provide a means whereby the support of tufting machine knives in tufting machines for use in producing fine gauge fabrics might be facilitated.

According to the present invention there is proposed a cutting instrumentality for a tufting machine which includes a multiplicity of knife bar modules arranged in end-to-end disposition collectively to define a knife bar of a length coextensive with the intended operating width of the tufting machine, each such module being adapted to receive and to support a respective multiplicity of knife blocks, and a multiplicity of knife blocks for application to and for support by the said modules, each said knife block being adapted to support a plurality of cutter knives in parallel side-by-side disposition thereon.

According to a further feature each module has a multiplicity of holes therein arranged in spaced apart parallel disposition each to receive a respective knife block spigot into engagement therewith, and is adapted releasably to be mounted in position upon a support means carried by the rocker bar of the tufting machine.

According to a further feature, the module is approximately five inches in length, thereby to provide for the standardisation of module size for tufting machines for producing tufted fabrics of a range of conventional gauge sizes.

Preferably, the knife block comprises a body part having a web dividing the body part to define a channel on each side of the web, there being at least two groove formations in the wall of each channel each adapted to receive a respective knife into engagement therewith, the groove formations being arranged in spaced disposition according to the intended separation of knives, and the web being of a thickness not greater than the intended separation of the knives.

According to a preferred feature, a channel is provided at each face of the body part, and two groove formations are provided in each such channel.

According to a further feature, an attachment means is provided for securing the knives in position within the knife block, such means comprising a capping piece engageable with an edge of selected knives and screw means operable on such capping piece to load the same into such engagement, the capping piece being slidable on pins within an aperture in the knife block and being adapted for engagement with knives supported in the block.

BRIEF DESCRIPTION OF THE DRAWINGS

The invention will now be described further, by way of example only, with reference to the accompanying drawings in which.

DESCRIPTION OF THE PREFERRED EMBODIMENT

Figure 1:
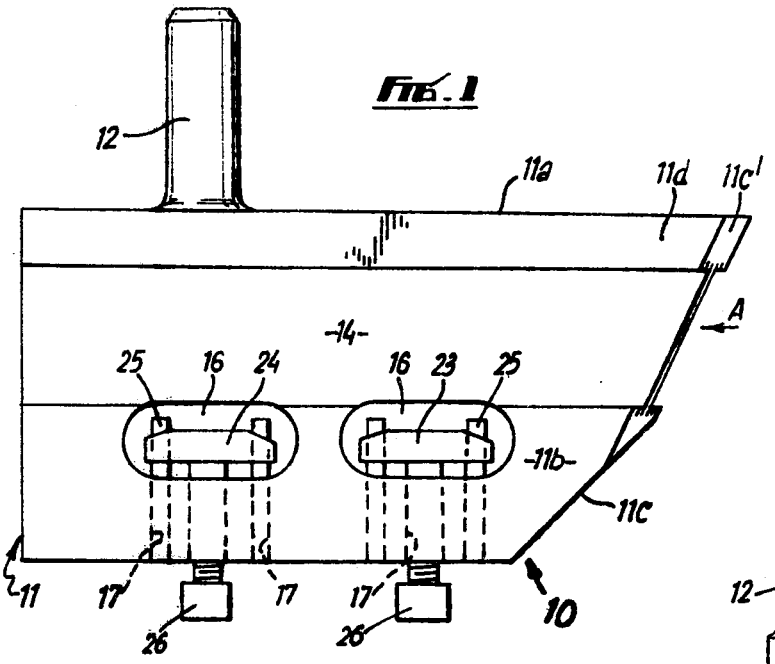
FIG. 1 is a front elevation of a knife block constructed in accordance with the invention.
Figure 2:
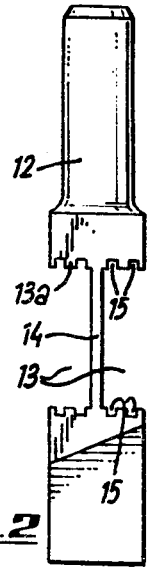
FIG. 2 is a view in the direction of arrow A in FIG. 1.
Figure 3:
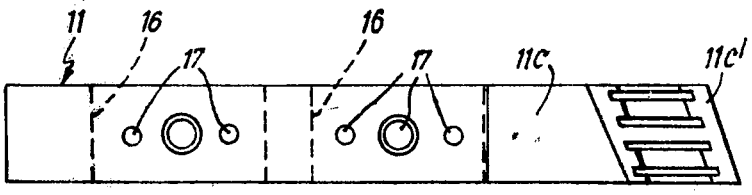
FIG. 3 is an inverted plan view of the knife block of FIGS. 1 and 2, the guide pins and screw means of such figures having been omitted.

Referring now to the drawings, and particularly to FIGS. 1 to 4 thereof, a knife block 10 for a fine gauge tufting machine comprises a generally rectangular body part 11 having a mounting pin 12 extending outwardly from a longitudinal edge 11*a* thereof. The body part 11 is channeled at each face, the channels 13 being parallel to the longitudinal edge, to divide the body part into spaced portions joined by an integral web 14 extending therebetween. The channels 13 are provided at corresponding locations at the two faces of the body part, and are asymetrically disposed in relation to the longitudinal center line thereof, being much closer to that longitudinal edge 11*a* from which the pin 12 extends than to the opposite longitudinal edge.

The side walls 13*a* of the channels are undercut to provide knife receiving grooves 15 therein, the grooves extending throughout the full longitudinal extent of the channel walls 13*a*, and corresponding grooves 15 in the opposed walls of each groove lying in respective planes parallel to the web. In the embodiment illustrated, two grooves are provided in each wall, the block thus being adapted to receive four knives, that is to say two at each side of the web 14, for co-operation with the respective ones of a corresponding number of loopers, and such grooves are equi-spaced at a distance consistent with the intended gauge of machine to which the block is to be applied.

That portion 11*b* of the body part remote from the pin 12 is provided with aligned apertures 16 therein, the said apertures 16 being of elongate form, and being so positioned in the transverse direction of the body part as to extend to the region of the web 14 and the major axes thereof being parallel to the longitudinal axis of the body part. A plurality of through holes 17 is provided in the body part in transverse alignment with each of the apertures, the apertures 16 and through holes 17 receiving an attachment means, as will hereafter be described in greater detail whereby the knives are secured in position within the respective grooves.

The forward face 11*c* of the body part is inclined in relation to the longitudinal edges thereof, the angle of inclination of such face differing as between that related to the portion 11*d* of the body part from which the mounting pin extends and the web 14, on the one hand, and that related to the remainder 11*b* of the body part, on the other. In addition, a part 11*c'* of the forward face 11*c* is bevelled, as can best be seen in FIG. 1.

Figure 9:
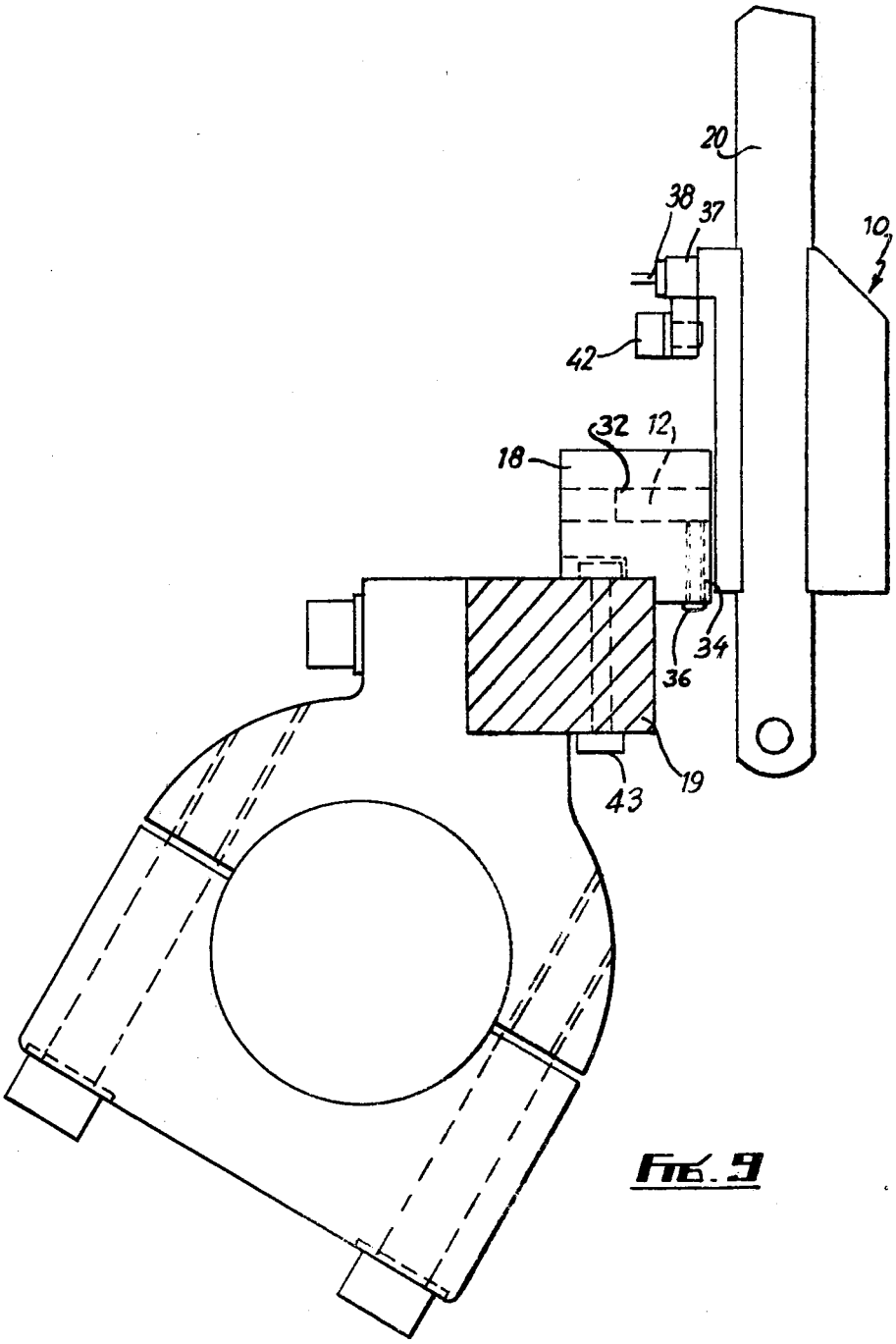
FIG. 9 is an end elevation partly in section of the arrangement shown in FIG. 8.

In use, see now FIG. 9, a multiplicity of knife blocks 10 as hereindisclosed is mounted on a knife bar 18 by engagement of the pins 12 each with a respective hole in the knife bar, the longitudinal axis of such blocks 10 being inclined relative to the axis of the knife bar according to requirements and such that the knives 20 approach the respective loopers (not illustrated) slightly from the side as is known in the art, the bevelled end face 11*c* of the knife block being approximately parallel to the axis of the knife bar. As the loopers and related knives 20 move relative to each other a loop of yarn which has moved towards the back of the looper will be cut to provide two side-by-side limbs extending from a common point in the backing fabric. According to the side from which the knife approaches the looper, so the bevel will be as shown, or of opposite hand thereto.

Figure 4:
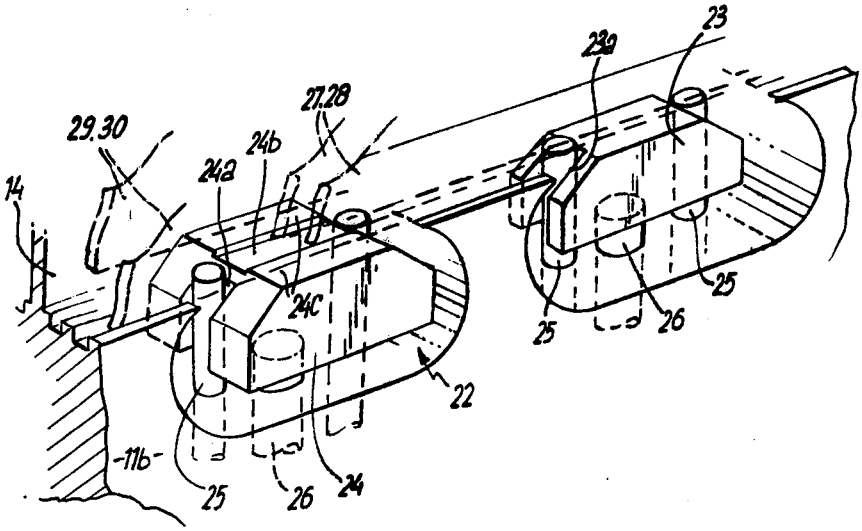
FIG. 4 is a perspective view, drawn to a larger scale, and partly broken away, of a part of the arrangement shown in FIG. 1 and illustrates in greater detail, the capping arrangement whereby knives are held in position within the knife block.

The means whereby the knives are secured in position in the knife block may be of conventional form, but will preferably be as shown in detail in FIGS. 1 and 4. Thus, the attachment means comprise inner and outer capping pieces 23, 24 each disposed in a respective one of the apertures 16 in the knife block 10, the said pieces being slidably mounted on guide pins 25 which engage detents 23*a*, 24*a* in the bevelled end faces of the generally rectangular capping pieces and which are located in to extend from the outermost ones of the through holes 17 provided in the body part 11 in register with each aperture 16.

A screw means 26 is provided for each capping piece 23, 24, the screw means 26 bearing on the underside (as shown) of the capping piece 23, 24 and being in screw-threaded engagement with the central through holes 17 in register with that aperture within which the capping piece is located. Progressive engagement of the screw means 26 with the screw-threaded hole 17 will move the related capping pieces 23, 24 towards the grooves 13 to engage the opposed longitudinal knife edge and secure the knife in position within the knife block.

As illustrated in FIG. 4, the inner capping piece 23 is intended for engagement with the two inner knives 27, 28 and is of a thickness appropriate to this purpose, being of a lesser thickness than the spacing between the two outer knives 29, 30 and having a generally planar upper surface. The outer capping piece 24 supports the two outermost knives 29, 30, and is of a thickness such as will reflect this purpose, there being a shallow recess 24*b* extending longitudinally of the upper surface of this capping piece to provide clearance on the innermost knives 27,28 and the lands 24*c* at either side of the recess 24*b* each being for engagement with a respective one of the outermost knives 29, 30.

By providing respective capping pieces 23, 24 for the inner and outer pair of knives, and by arranging that the knives are disposed symmetrically in relation to the body part 11 in the thickness direction thereof, so we are able to avoid the introduction of adverse stresses in the body part on securing of the knives therein, this being important having regard to the small cross-sectional dimensions of, for example, the web 14 and the need to maintain a relative positioning of the knives in each knife block and in relation to the knives supported in adjacent knife blocks.

The provision of detents 23*a*, 24*a* in the ends of the capping pieces each to receive a respective guide pin 25 as a clearance fit therein will ensure that the capping pieces 23, 24 remain captive in the apertures 16 in the knife block 18 yet be movable into securing engagement with the knife edges on progressive engagement of the screw means 26 with the through hole 17 with which it is engaged.

A locknut, not shown, may be provided in relation to the screw means 26, if desired.

Preferably, the knife bar 18 comprises a plurality of modules arranged in end-to-end disposition, each module being secured to a knife bar support 19 and being adapted to receive and support, say, sixteen knife blocks.

Figure 5:
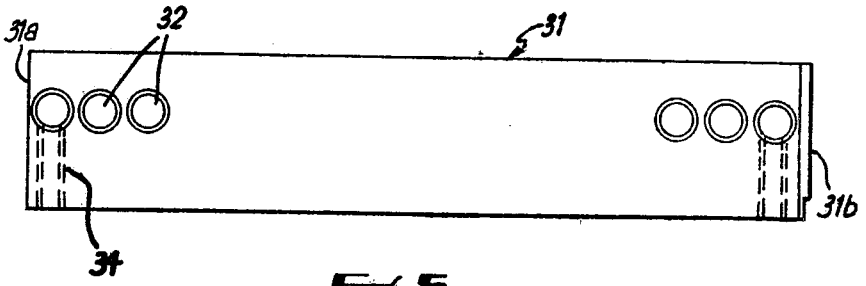
FIG. 5 is a rear elevation of a knife bar module, a plurality of which modules are arranged in end-to-end disposition to provide a knife bar support extending throughout the length of the tufting machine.
Figure 6:
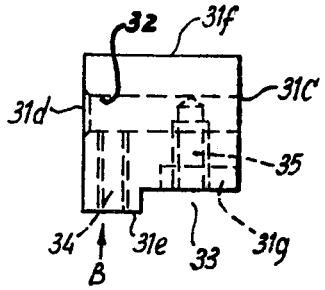
FIG. 6 is an end elevation of the module shown in FIG. 5.
Figure 7:
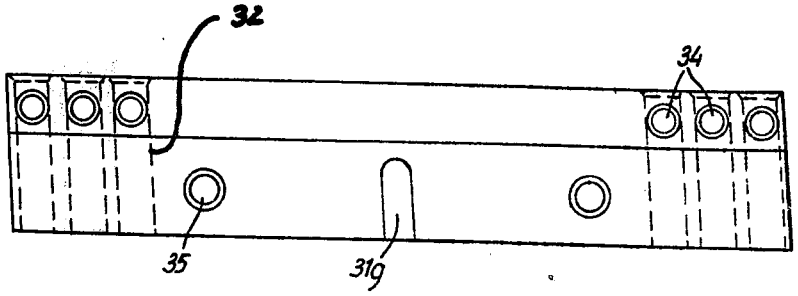
FIG. 7 is a view in the direction of arrow B in FIG. 6.

Referring now to FIGS. 5 to 7 of the drawings, each knife bar module comprises a generally rectangular body part 31 having a multiplicity of through holes 32 therein arranged in adjacent side-by-side disposition and extending from front to rear of the body part, each to receive the spigot 12 of a knife block 10 into engagement therewith. The end faces 31*a*, 31*b* of the block are parallel and inclined slightly, say at an angle of 4°, relative to the front and rear faces 31*c*, 31*d* thereof, whilst the underside 31*e* of the block is stepped at the forward end thereof to provide a seating, as at 33, for seating engagement with a knife bar support 18, as will hereafter be made apparent.

A multiplicity of threaded holes 34 is provided in the body part, one for each respective spigot receiving hole 32, the threaded holes 34 extending from the underside of the body part adjacent the rear face thereof to break into the spigot receiving holes 32. Two further threaded holes 35 are provided in the body part 31, such holes being positioned in the stepped position of the underside of the body part adjacent the front face thereof and being intended to receive bolts 44 whereby the module is secured to the knife bar support 19.

The spigot receiving holes 32 are parallel to each other and to the inclined end faces 31*a*, 31*b* of the body part 31, and are also parallel to the lower and upper faces 31*e*, 31*f*, respectively of such body part.

In the embodiment illustrated, the body part 31 is marginally less than five inches long and sixteen holes are provided therein at 0.3125 inch centers, thus giving, when used with a four-knife block in each spigot receiving hole, an array of knives at 0.0781 (or five sixty-fourth) inch centers. If the spigot receiving hole diameter is approximately 0.22 inches, there will be approximately 0.092 inches between each hole and a material thickness of approximately 0.046 inches outwardly of each of the extreme holes.

For a module of corresponding length for use with a conventional two-knife block, thirty two spigot receiving holes would be needed at 0.156 inch centers thus giving, for a spigot receiving hole diameter of, say, 0.125 inches, a land between adjacent holes of approximately 0.031 inches and a material thickness at the ends of the module of only 0.015 inches.

As can be appreciated, by using four-knife blocks, so it is possible to provide a knife bar arrangement appropriate to the production of a 5/64's gauge fabric, whilst still being able to use knife blocks having spigots of substantial cross-section (and thus strength) and a module having a substantial thickness of metal between adjacent spigot receiving holes and outwardly of the end such holes.

By adopting a module of approximately five inches in length, so we are able to standardise on a module length for the majority of the range of conventional gauge sizes used in the tufting machine art.

Figure 8:
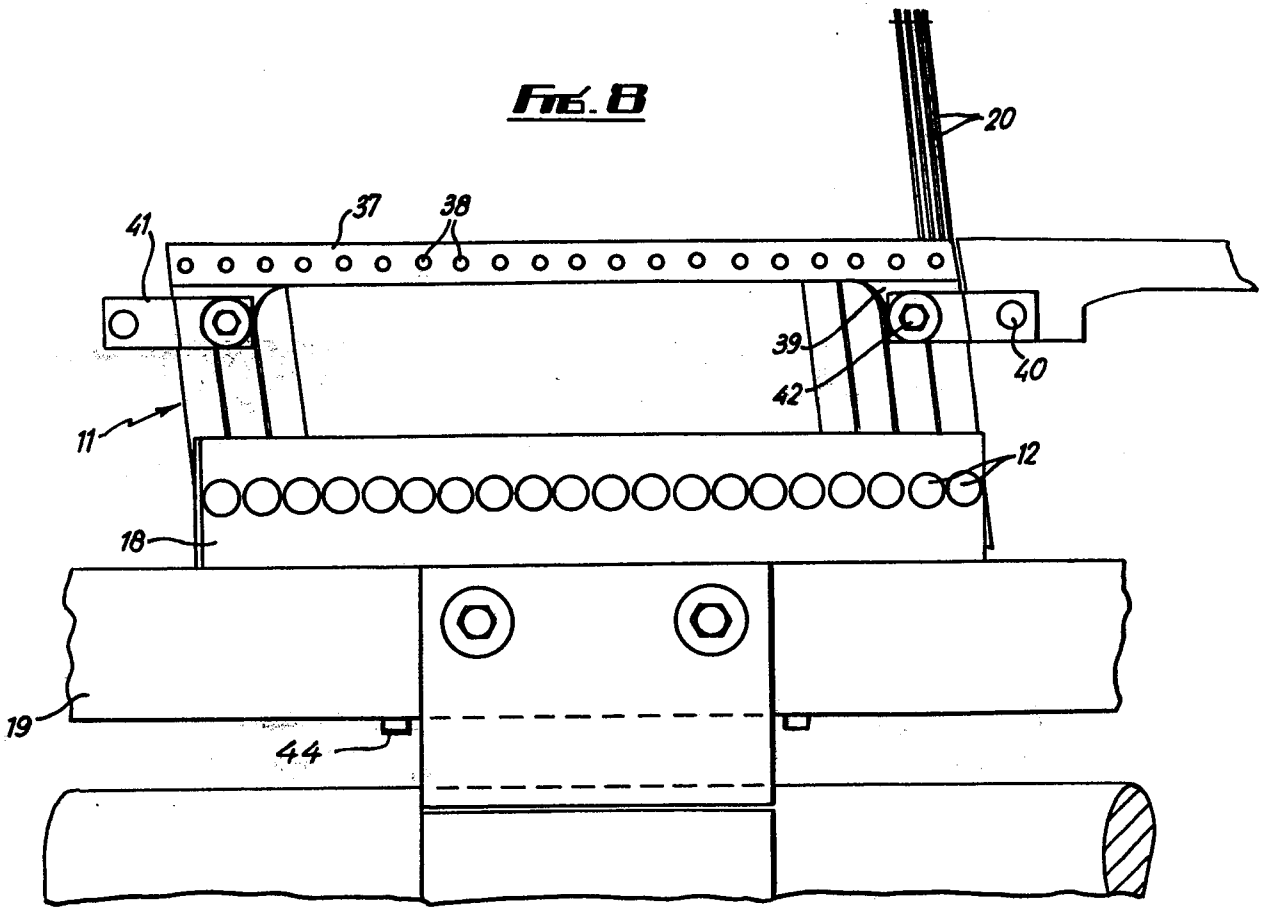
FIG. 8 is a diagrammatic front elevation of the module as shown in FIGS. 5 to 7 as applied to a tufting machine.
Figure 10:
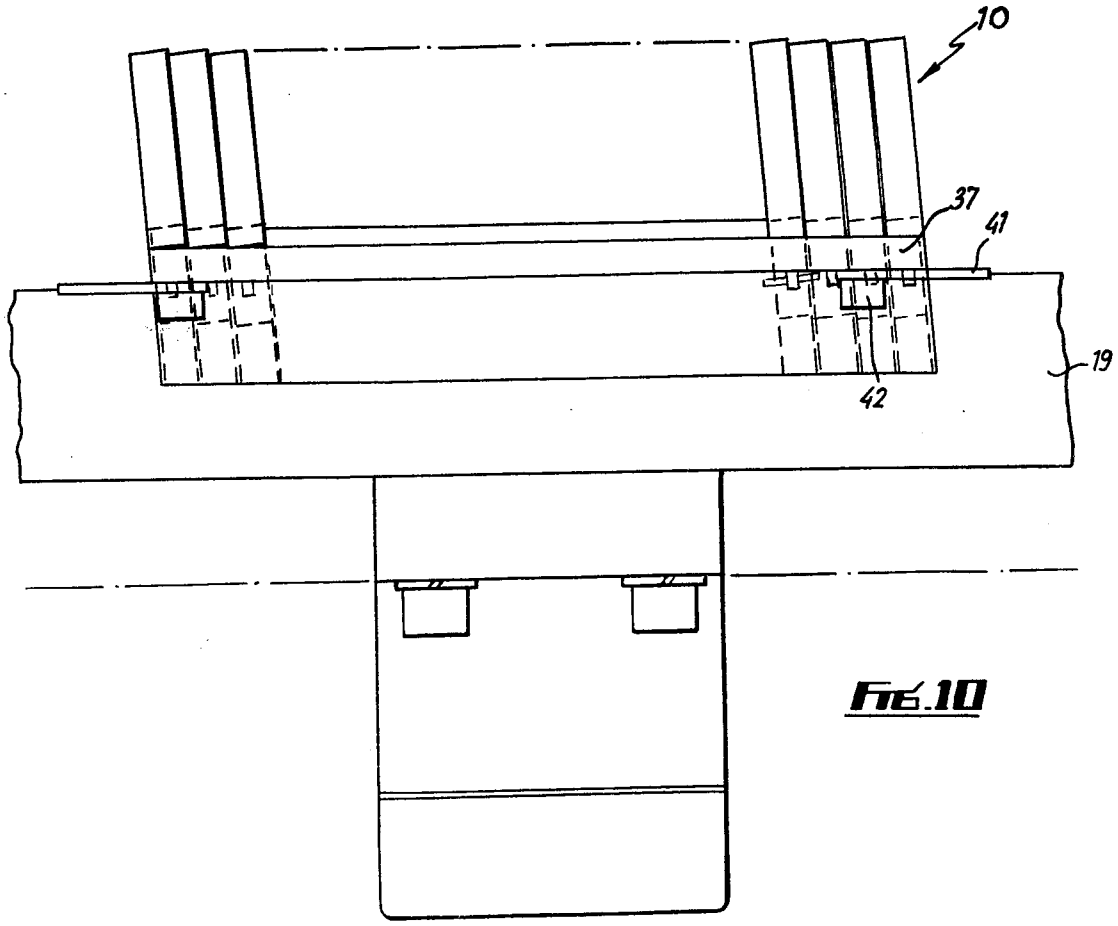
FIG. 10 is a plan view of the arrangement shown in FIGS. 8 and 9.

In use, in a tufting machine, see now FIGS. 8 to 10, a plurality of modules as aforesaid is applied to a knife bar support 19 in end-to-end disposition thereon, the stepped underside 31*e* of each module being seated on the knife bar support and the modules being secured in position by bolts 44 engaged with threaded holes 35. Having regard to the fact that the material thickness at each end of each module is substantially equal to one half of the material thickness between adjacent spigot receiving holes 32, the pitch of the spigot receiving holes 32 remains constant throughout the length of the full knife bar as defined by the plurality of modules.

Knife blocks 10 are mounted on the modules by engagement of the spigots 12 of such blocks with respective spigot receiving holes 32 in the modules and are secured in a requisite angular position therein by screws 36 engaged with the holes 34 in the module and which extend into abutment with the respective spigots 12.

In order to facilitate the simultaneous adjustment of the angular disposition of the knives 20 supported in the various knife blocks 11, an adjuster bar 37 is provided in respect of each module, the adjuster bars 37 engaging respective pins 38 mounted in each knife block. The adjuster bar 37 has a depending lug 39 at each end thereof, there being a screw-threaded hole 40 in each lug 39, whereby adjacent bars 37 are secured together by means of a jointing piece 41 extending between and secured to adjacent lugs by bolts 42 engaged with the screw threaded holes.

A means is provided for effecting adjustment of each module longitudinally of the knife bar support, such means comprising a screw 43 (FIG. 9) extending through such support 19 and having the inner end thereof in engagement with an open-ended slot 31*g* in the underside 31*e* of the module. The inner end of the screw 43 is of eccentric form and co-operates with the flanks of the slot 31*g* to effect a longitudinal shift of the module on rotation of the screw within limits imposed by the dimensions of the eccentric, thereby allowing of a limited adjustment of the position of the module or the knife bar support, it being assumed that bolts securing the module to the knife bar support are slackened off to allow of such adjustment.

The invention is not restricted to the exact features of the arrangements herein described and illustrated, since alternatives will readily present themselves to one skilled in the art.

Thus, for example, the knife block may be adapted to receive and support more than the four knives of the embodiment hereinbefore set forth, by the provision of the appropriate additional channels in the groove side walls, the attachment means including provision for the securing of the knives in the block in pairs, and thus three such means being provided in the case of a block intended to carry six knives. All such modifications which do not depart from the spirit of the invention are intended to be included within the scope of the appended claims.

Having thus set forth the nature of the invention, what is claimed is:

1. In a tufting machine having a knife bar support member extending longitudinally of the machine, a cutting instrumentality including a multiplicity of knife bar modules, means for mounting said modules in end-to-end disposition collectively on said knife bar support to define a knife bar of a length coextensive with the intended operating width of the tufting machine, a multiplicity of knife blocks, said modules and said knife blocks having cooperable means for mounting a multiplicity of knife blocks on each module, each knife block comprising a body part having a pair of spaced apart side walls connected together by a web to define a channel on each side therof, each channel having means defining at least two spaced apart parallel pairs of aligned grooves in said side walls for receiving a knife in each pair of grooves, the spacing between adjacent pairs of grooves being equal to the intended separation of the knives, the webs being of a thickness not greater than the intended separation of the knives, said means for mounting said modules on said support includes adjusting means for effecting limited adjustment longitudinally of said knife bar support, said adjusting means comprising an open ended slot in each module and an eccentric adjusting member on said support.

2. A cutting instrumentality as recited in claim 1, wherein said cooperable mounting means comprises a spigot on each knife block and a multiplicity of holes in each module, said holes being arranged in spaced apart parallel disposition each to receive a respective knife block spigot, and means for releasably securing each spigot in a respective hole.

3. A cutting instrumentality as claimed in claim 2, wherein the axes of said holes lie in respective parallel planes inclined relatively to the longitudinal axis of the module.

4. A cutting instrumentality as recited in claim 3, wherein the said axes are inclined at an angle of approximately 4 degrees to the longitudinal axis of the module.

5. A cutting instrumentality as recited in claim 4, wherein the end faces of the module are parallel to the said respective parallel planes.

6. A cutting instrumentality as recited in claim 2, wherein the underside of each module is stepped to provide a seating for engagement with said knife bar support.

7. A cutting instrumentality as recited in claim 1, including an adjustment bar for each module, each knife block having a multiplicity of pins cooperably attached to said adjustment bar, thereby to interconnect the knife blocks for simultaneous angular adjustment in the module.

8. A cutting instrumentality as recited in claim 7, including means for interconnecting the adjustment bars of adjacent modules, thereby to provide for a simultaneous angular adjustment of the knife blocks in more than one module.

9. A knife block for a tufting machine comprising a body part having a pair of spaced apart side walls connected together by a web to define a channel on each side thereof, each channel having means defining at least two spaced apart parallel pairs of aligned grooves in said side walls for receiving a knife in each pair of grooves, the spacing between adjacent pairs of grooves being equal to the intended separation of the knives, the web being of a thickness not greater than the intended separation of the knives, said knife block including a plurality of capping pieces engageable with selected knives for securing the knives in position within said block, each of said capping pieces being engageable with a knife on each side of said web, and means for adjustably forcing said capping pieces against said knives to secure the knives in the block wherein the body part of the knife block includes aperture means adjacent said channels, said aperture means extending into the web, said capping pieces being disposed in said aperture means, and a plurality of pins associated with each capping piece in said aperture means, each pin having an axis extending substantially parallel to the plane of said web, and guide means in said capping pieces for receiving said pins for relative slidable movement between said capping pieces and said pins.

10. A knife block as recited in claim 9, wherein the knife block supports four knives arranged two at either side of the web and two capping pieces are provided each for cooperation with a pair of inner and outer knives respectively.

11. A knife block for a tufting machine as recited in claim 10, wherein the capping piece associated with the outermost knives has a central recess extending in the longitudinal direction of said web to provide a clearance on the inner pair of knives.

* * * * *